United States Patent [19]

Cale

[11] 4,159,187

[45] Jun. 26, 1979

[54] FIVE PIECE BRAKE LEVER CONNECTION

[75] Inventor: Roland E. Cale, Cortland, Ohio

[73] Assignee: Schaefer Equipment Incorporated, Warren, Ohio

[21] Appl. No.: 938,327

[22] Filed: Aug. 30, 1978

[51] Int. Cl.[2] ..... B25G 3/34

[52] U.S. Cl. ..... 403/272; 403/157; 188/52; 29/175 A

[58] Field of Search ..... 403/270, 271, 272, 157, 403/158, 159, 43–48; 188/52, 219.1; 105/176, 209, 199 A; 29/175 A

[56] References Cited

U.S. PATENT DOCUMENTS

| | | | |
|---|---|---|---|
| 1,708,115 | 4/1929 | Baldwin | 29/175 A |
| 2,179,089 | 11/1939 | Hauf | 403/272 X |
| 2,480,958 | 9/1949 | Pietzsch | 403/270 X |
| 2,487,169 | 11/1949 | Newell | 403/270 X |
| 2,544,398 | 3/1951 | Schaefer | 403/272 |
| 4,096,787 | 6/1978 | Sandau | 403/271 X |

*Primary Examiner*—Wayne L. Shedd

*Attorney, Agent, or Firm*—Brown, Flick & Peckham

[57] ABSTRACT

A brake lever connection is formed from a tube with a two-piece jaw welded to each end, each jaw having laterally spaced side portions merging at one end into end portions engaging each other to form the inner end of the jaw, which has a first frusto-conical surface tapered toward the other jaw and merging into a smaller diameter frusto-conical surface tapered less sharply. The larger end of the smaller conical surface has about the same diameter as the inside of the tube, into an end of which the smaller conical surface is inserted. The end walls of the tube form with the first conical surfaces annular recesses filled with welding metal that joins the jaws to the ends of the tube.

3 Claims, 4 Drawing Figures

FIVE PIECE BRAKE LEVER CONNECTION

A brake lever connection is a rod-like member that is pivotally connected at its opposite ends to the two brake levers of railway car brake rigging. The connection may extend across the top or the bottom of the car truck bolster or through an opening through the bolster. The customary way of making such a connection is by forging it in one piece to form jaws at the opposite ends of a straight central portion. For clearance reasons, some modern freight cars require the central portion of the connection to be offset relative to the end jaws. Although the central portion of the conventional straight connection can be offset by bending it, this requires special equipment to firmly clamp the jaws in fixed position during the bending operation.

It is among the objects of this invention to provide a brake lever connection, in which its jaws and central portion that connects them are made in separate operations and then assembled and welded together, and in which the central portion of the connection can be bent or curved to the desired extent before the jaws are welded to its opposite ends.

The preferred embodiment of the invention is illustrated in the accompanying drawings, in which FIG. 1 is a side view of brake rigging containing the brake lever connection;

Figure 4:
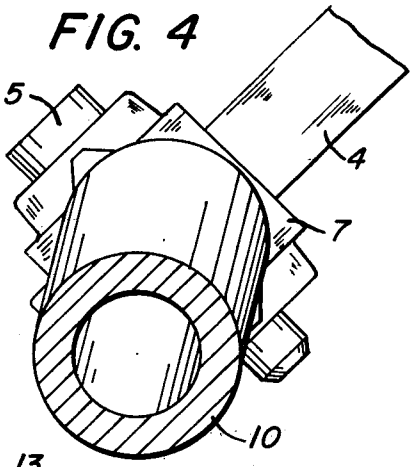
FIG. 4 is an enlarged cross section taken on the line IV—IV of FIG. 1.
Figure 1:
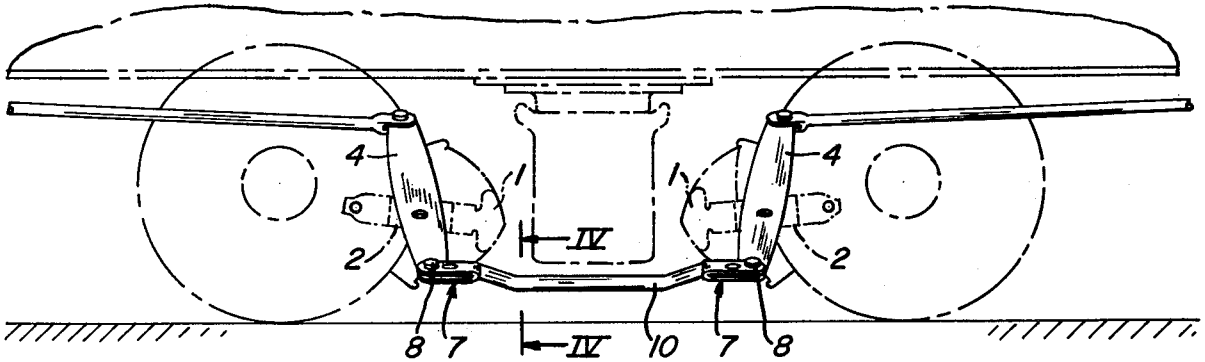
Figure 2:
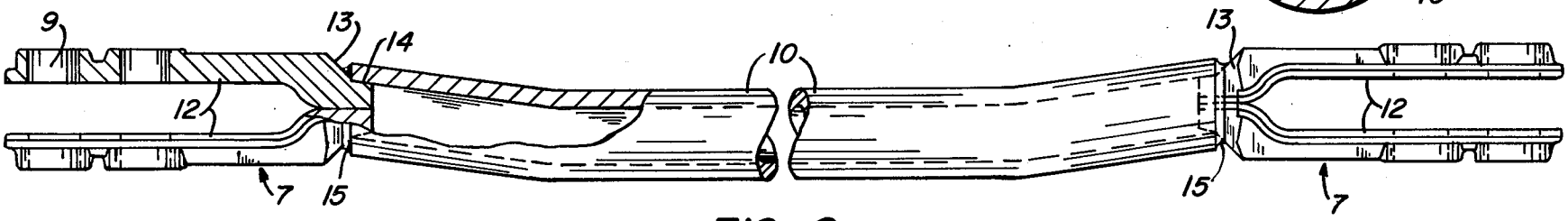
FIG. 2 is an enlarged view of the connection, partly in section.
Figure 3:
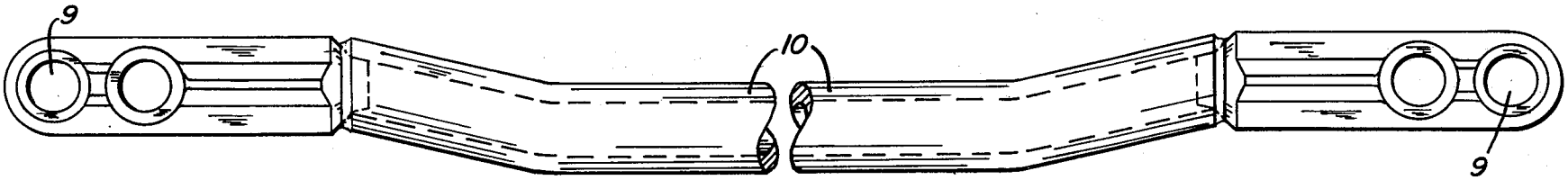
FIG. 3 is a view of the connection at 90° to FIG. 2.

Referring to FIG. 1 of the drawings, a railway car truck is provided with a pair of brake beams 1 of conventional construction, each of which includes a central strut 2 extending lengthwise of the car and provided with an inclined slot therethrough. Extending through the strut slot is a brake lever 4 that is held in place by a pivot pin 5 (FIG. 4) extending through the slot and an opening in the lever. The lower ends of the two brake levers are shown connected by a connecting rod or brake lever connection that extends beneath the truck bolster 6. This connection has two axially aligned jaws 7 straddling the brake levers and connected to them by pivot pins 8 extending through openings 9 (FIGS. 2 and 3) in the jaws. The adjacent or inner ends of the two jaws are connected by the central rod-like portion 10 of the connection.

It is a feature of this invention that the connection, instead of being made in one piece as is the usual practice, is formed from five separate pieces and a pair of annular welds. Accordingly, each jaw 7 is formed from two identical forged pieces 12. They are so formed and assembled as to form a jaw having laterally spaced parallel side portions that merge at their inner ends into laterally offset end portions which engage each other to form the inner end of the jaw. The inner end of each jaw has a first frusto-conical surface 13 that is tapered toward the other jaw and that merges into a smaller diameter second frusto-conical surface 14 tapered less sharply in the same direction. The central portion 10 of the connection that extends from one jaw to the other is a metal tube.

The diameter of the larger end of the smaller conical surface 14 of each jaw is substantially the same as the inside diameter of the tube. Consequently, when this smaller conical surface of a jaw is inserted in one end of the tube, the tube will hold the inner ends of the two pieces 12 together and center the jaw relative to the tube. Also, the end wall of the tube will form with the exposed larger conical surface 13 of the jaw an inwardly tapered recess encircling the inner end of the jaw. This recess is then filled with a ring of welding metal 15 by arc welding to join the jaw to the end of the tube. With the two axially aligned jaws welded to the ends of the tube, the connection is complete and is strong and rigid.

The big advantage of making the connection in this way is that if its central portion (the tube 10) is to be other than straight; that is, curved lengthwise or provided with end portions that are inclined to the longitudinal axes of the jaws, it is a relatively simple matter to bend the tube to the desired configuration before the jaws are welded to it. When the tube is to be bent in this manner, its ends are cut off at such an angle to its axis as to cause the end walls of the bent tube to lie in substantially parallel planes perpendicular to the longitudinal axes of the jaws.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A brake lever connection comprising a tube, a two piece jaw at each end of the tube, each jaw having laterally spaced parallel side portions provided with pivot pin receiving openings and merging at only one end into laterally offset end portions engaging each other to form the inner end of the jaw, each of said inner ends having a first frusto-conical surface tapered toward the other jaw and merging into a smaller diameter second frusto-conical surface tapered less sharply in the same direction, the larger end of said smaller conical surface having substantially the same diameter as the inside of said tube, said smaller conical surfaces being inserted in the opposite ends of the tube, the end walls of the tube forming with said first conical surfaces inwardly tapered annular recesses, and welding metal filling said recesses and joining the jaws to the ends of the tube.

2. A brake lever connection according to claim 1, in which the end portions of said tube are inclined to the longitudinal axes of said jaws.

3. A brake lever connection according to claim 2, in which said end walls of the tube lie in substantially parallel planes perpendicular to said jaw axes.

* * * * *